US005535731A

United States Patent [19]

Webster

[11] Patent Number: 5,535,731

[45] Date of Patent: Jul. 16, 1996

[54] ARCHERY BOW STABILIZER

[76] Inventor: Mark A. Webster, 315 Aspen Dr., Lawrenceburg, Ky. 40342

[21] Appl. No.: 404,062

[22] Filed: Mar. 14, 1995

[51] Int. Cl.[6] ..... F41B 5/20

[52] U.S. Cl. ..... 124/89

[58] Field of Search ..... 124/86, 88, 89

[56] References Cited

U.S. PATENT DOCUMENTS

| | | | |
|---|---|---|---|
| 3,752,142 | 8/1973 | Morita et al. | 124/89 |
| 4,054,121 | 10/1977 | Hoyt | 124/89 |
| 4,135,486 | 1/1979 | Enomoto | 124/89 |
| 4,245,612 | 1/1981 | Finlay | 124/89 |
| 4,553,522 | 11/1985 | Topping | 124/89 |
| 4,556,042 | 12/1985 | Izuta | 124/89 |
| 5,273,022 | 12/1993 | Leven | 124/89 |

*Primary Examiner*—Eric K. Nicholson
*Assistant Examiner*—John A. Ricci
*Attorney, Agent, or Firm*—Richard C. Litman

[57] ABSTRACT

An archery bow stabilizer comprises a set of four rods or arms which extend from an attachment block, which block is attachable to a standard stabilizer attachment fitting on an archery bow. The attachment block defines a common intersection for each pair of arms, thereby providing a simple resolution of the forces involved, and provides for each of the four arms to extend into one of the four quadrants defined by the longitudinal and lateral axes of the bow. The outer tip of each of the stabilizing arms or rods is downwardly disposed, thereby providing additional clearance for the archer's arm and sight line, and also for the release of an arrow from the bow. The downwardly disposed arms include removably adjustable masses at their tips, which also serve to lower the common center of mass of the bow and stabilizer assembly to a point approximating the hand grip of the bow, for greater stability. The present stabilizer is particularly suited for use with compound bows, but may be used with conventional long bows as well.

20 Claims, 3 Drawing Sheets

ARCHERY BOW STABILIZER

FIELD OF THE INVENTION

The present invention relates generally to the field of archery, and more specifically to a stabilizing device attachable to an archery bow to preclude excessive movement of the bow at the time the arrow is released. The present stabilizer is adapted particularly to compound bows, but may be used with conventional long bows and the like.

BACKGROUND OF THE INVENTION

The accurate use of an archery bow is a skill which very nearly approaches an art form. It is generally considered to be considerably more difficult to shoot an archery bow accurately than a firearm, as the projectile (arrow) generally has a much higher percentage of mass in comparison to the bow than does a bullet to a gun, and the speed of the arrow is comparatively much less.

The above factors result in a tendency for the bow to deflect from the desired alignment when the bow string is released and the arrow is fired; such deflection of the bow may occur due to the physical reactive forces acting upon the bow from the arrow's departure, and/or may be due to the reaction of the archer to the movement of the bow at the release of the bow string. These reactive forces are somewhat greater with a compound bow, wherein the bow string is drawn over a series of pulleys to amplify the force, than with a standard long bow. In any event, some means of stabilizing the bow to preclude movement of the bow at the point of release of the bow string and the initiation of the flight of the arrow from the bow, is highly desirable.

Typically, such reactions cause the bow to tip slightly forward, due to the center of mass of the bow being essentially at the arrow rest and above the archer's hand grip, and/or to twist or torque slightly due to the bodily reaction of the archer's arm and wrist holding the bow as the bow moves when the bow string is released. Numerous archery bow stabilizers have been developed in the past, as will be discussed in the Description of the Prior Art below, but none are adapted to provide full stabilization of a bow, particularly a compound bow, about both the vertical and lateral axes of the bow, as accomplished by the present invention.

DESCRIPTION OF THE PRIOR ART

U.S. Pat. No. 4,135,486 issued to Kouichi Enomoto on Jan. 23, 1979 discloses an Archery Bow Stabilizer in which at least a portion of the stabilizing mass is imbedded in the bow itself, rather than being extended substantially in front of the bow. The imbedded damper portion is somewhat resilient, in order to allow the stabilizer rod to move at least somewhat relative to the bow when the bow string is released, thereby allowing the bow to vibrate somewhat relative to the stabilizer arms. Such vibratory oscillation is undesirable, and one of the objects of the present stabilizer device is to prevent such oscillations insofar as possible. The Enomoto device is also disposed in pairs substantially equally above and below the center of mass of the bow and coplanar with the plane of the bow. Thus, the center of mass of the bow and stabilizer assembly is unchanged, remaining substantially at the arrow rest and above the hand grip portion, where any motion of the bow about its center of mass, and/or any motion of the hand gripping the bow, tends to produce a torque.

U.S. Pat. No. 4,245,612 issued to Robert L. Finlay on Jan. 20, 1981 discloses an Archery Bow Stabilizer having weights housed within an enclosure at the distal end of the stabilizer shaft. The weights are resiliently held in place by a spring. The device is primarily intended for use in hunting, as it also includes passages to provide for the emanation of a scent to lure the game and/or mask human scent, unlike the present stabilizer.

U.S. Pat. No. 4,556,042 issued to Tadao Izuta on Dec. 3, 1985 discloses a Stabilizer For Archery Bows comprising a single lateral crossmember having a weight at each end thereof. Forward movement of the weights and arm is restricted by a relatively rigid retaining member. The device is attached to the back side of the bow, with the retaining member restricting rearward movement of the arms. Thus, the effect is to reduce rearward movement of the bow at the launch of the arrow, by restricting forward movement of the arms and weights, rather than to reduce angular movement of the bow at the point of bow string release. As the device is located very close to the arrow rest, and thus the center of mass of the bow, above the hand grip, very little effect is provided to reduce any tipping of the bow about the lateral axis across the bow. The device must rely upon additional stabilizers, as shown in FIG. 1 of the Izuta patent drawings. In addition, Izuta fails to provide any means of adjusting the mass of his stabilizer.

Finally, U.S. Pat. No. 5,273,022 issued to William L. Leven on Dec. 28, 1993 discloses a Weight Support For Archery Bow Stabilizers, comprising a flaccid elastic member within an elongate tube. The device is supposed to absorb vibration through the elastic member within the tube. Only a single stabilizer arm is disclosed, extending forwardly of the bow at substantially a right angle to the flight path of an arrow launched from the bow. The relatively long arm, with its mass disposed at the distal end thereof, would provide some stabilization of the bow about the vertical and lateral axes, but the single arm disclosed requires either a relatively large amount of weight or an inordinately long arm to provide the required damping moment. Moreover, the device is secured to the bow immediately below the hand grip area, close to the center of mass, and does little to compensate for the center of mass of the bow being positioned above the hand grip.

None of the above noted patents, taken either singly or in combination, are seen to disclose the specific arrangement of concepts disclosed by the present invention.

SUMMARY OF THE INVENTION

By the present invention, an improved archery bow stabilizer is disclosed.

Accordingly, one of the objects of the present invention is to provide an improved archery bow stabilizer which is particularly adapted for use with a compound bow, but which may also be used with other types of bows, such as conventional long bows.

Another of the objects of the present invention is to provide an improved archery bow stabilizer which includes stabilizing arms or rods extending into each quadrant defined by the longitudinal and lateral axes of the bow, to provide a stabilizing effect about the longitudinal, lateral, and vertical axes of the bow.

Yet another of the objects of the present invention is to provide an improved archery bow stabilizer which stabilizing arms are downwardly oriented, serving to provide clearance from the hand grip area of the bow and for the launch and flight of an arrow.

Still another of the objects of the present invention is to provide an improved archery bow stabilizer which downwardly oriented arms include stabilizing masses at each tip, which masses are disposed below the hand grip of the bow and serve to lower the center of mass of the bow to the approximate hand grip area.

A further object of the present invention is to provide an improved archery bow stabilizer which stabilizing masses are easily adjustable as desired, independently of one another.

An additional object of the present invention is to provide an improved archery bow stabilizer which stabilizer arms secure to a central block providing for attachment to the bow at a standard stabilizer mounting point, with the block providing for a common intersection point of the axes of each of the pairs of stabilizer arms or rods.

Another object of the present invention is to provide an improved archery bow stabilizer which arms are formed of aluminum tubes, with the distal ends of the tubes being threaded to provide for the threaded engagement of screws therein to secure variable quantities of weights thereto.

A final object of the present invention is to provide an improved archery bow stabilizer for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
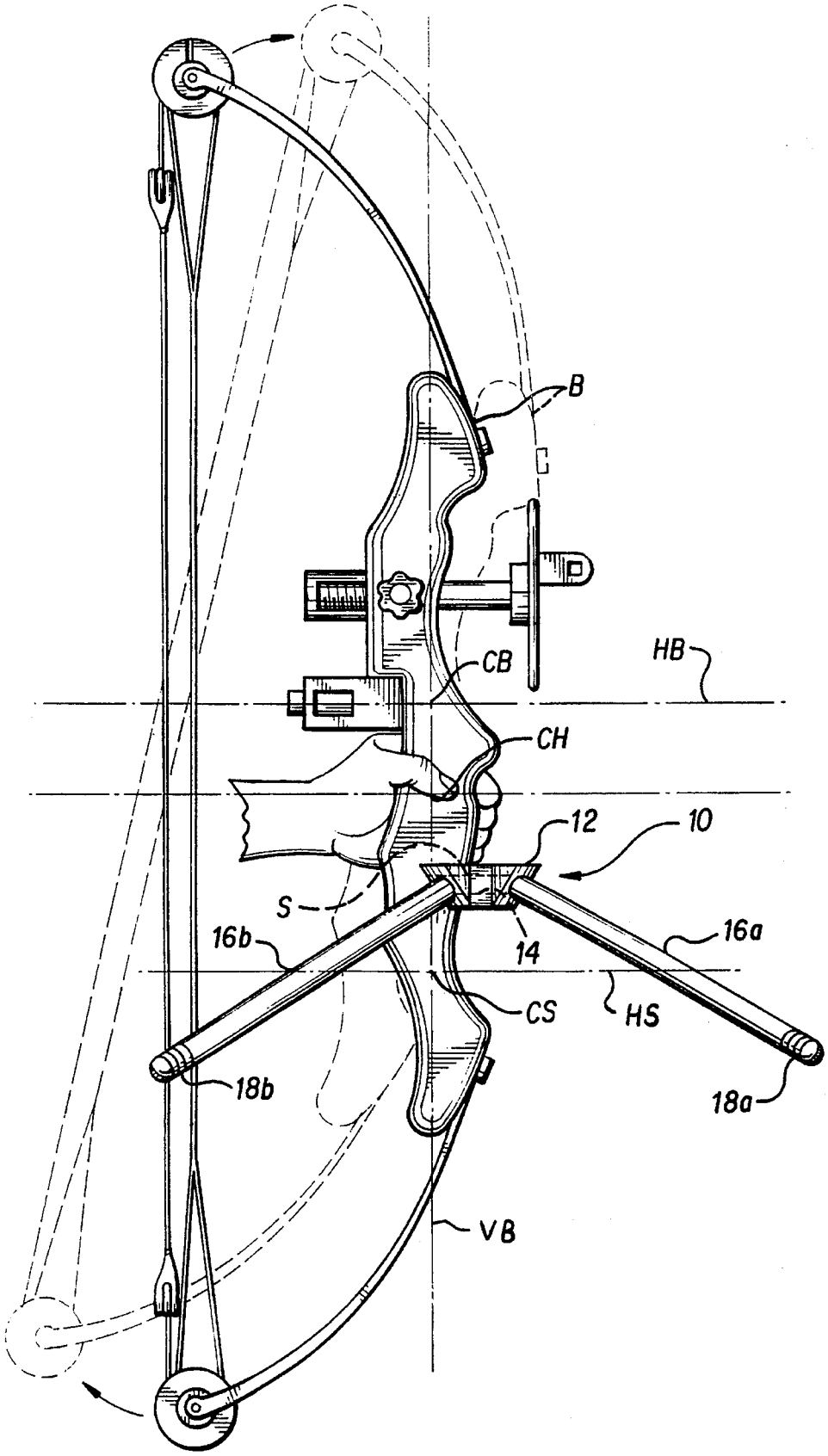
FIG. 1 is a right side view of a compound archery bow having a stabilizer of the present invention attached thereto, and showing the movement of the bow at the launch of an arrow, the longitudinal and vertical axes of the bow, and the movement of the center of mass of the bow by means of the present stabilizer.
Figure 2:
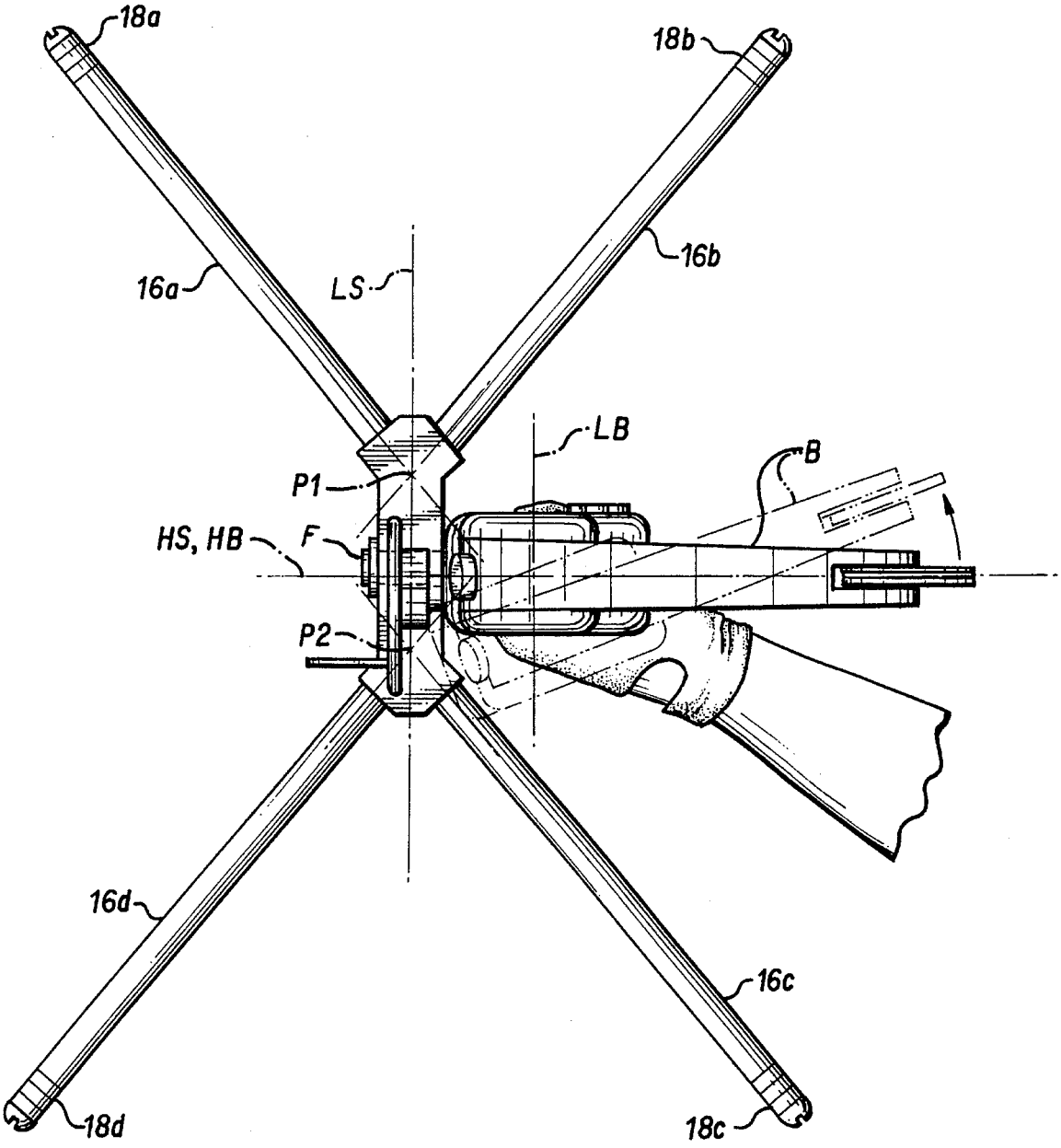
FIG. 2 is a top plan view of a compound bow with the present stabilizer attached thereto, further showing bow movement due to arrow release and the longitudinal and lateral axes of the bow.

Referring now particularly to FIG. 1 of the drawings, the present invention will be seen to relate to an archery bow stabilizer 10, which is removably attachable to an archery bow B. (The bow B may be a compound bow, with a pulley and/or cam system providing for the amplification of draw string force, as shown in FIGS. 1 and 2, but it will be seen that the present bow stabilizer 10 may also be removably secured to a conventional long bow, if desired.) The stabilizer 10 is normally secured to the front stabilizer attachment point or socket S of the bow B, as shown in hidden lines in FIG. 1; attachment means may be a threaded screw or bolt or other removable means adapted to the bow B as required.

Figure 3:
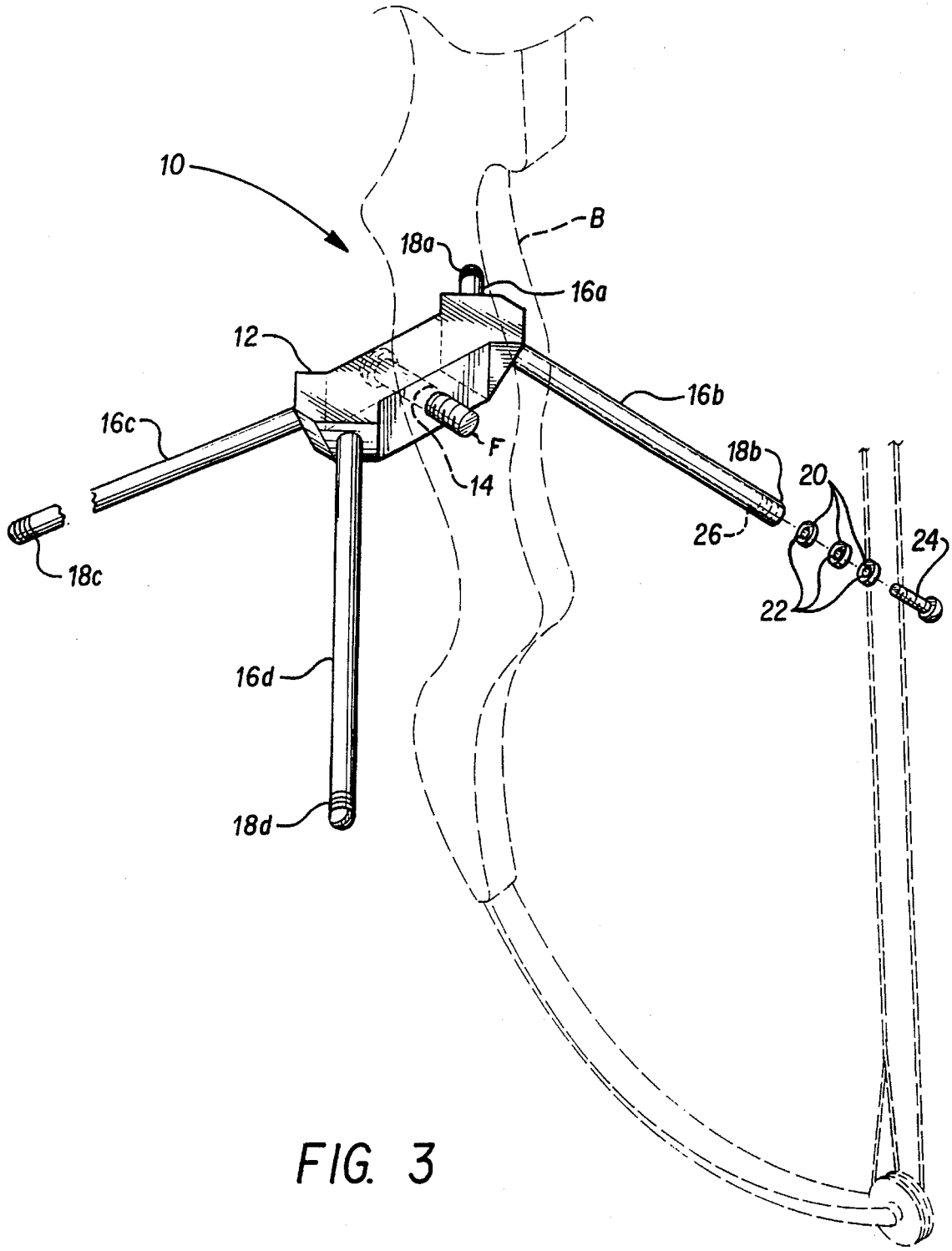
FIG. 3 is a left rear perspective view of the present archery bow stabilizer, showing its general configuration and the means for securing the removably attachable tip weights thereto.

The stabilizer 10 includes a central attachment block (preferably aluminum, although other materials may be used), which block 12 provides for the attachment of the stabilizer 10 to the bow B. A longitudinal passage 14 (coincident with the attachment socket S in the bow B of FIG. 1, and more clearly shown in FIG. 3) provides for the insertion of an attachment fastener F (bolt or screw, as shown in FIGS. 2 and 3) therethrough.

The stabilizer attachment block 12 includes a horizontal longitudinal axis HS, defined as being generally parallel to the path of an arrow launched from the bow B, and a lateral axis LS also in the horizontal plane and perpendicular to the horizontal longitudinal axis HS. These two axes are parallel to the longitudinal and lateral axes HB and LB of the bow B, when the stabilizer 10 is installed thereon, and are shown in the plan view of FIG. 2 of the drawings. These two stabilizer axes HS and LS will be seen to define four quadrants (left and right front and left and right rear) about the stabilizer attachment block 12.

Two stabilizer arms **16*a* and 16*b* extend from the right side of the stabilizer attachment block 12, respectively forwardly and rearwardly of the lateral stabilizer axis LS, and two opposite stabilizer arms 16*c* and 16*d* extend from the right side of the block 12, respectively rearwardly and forwardly of the lateral stabilizer axis LS. Thus, one stabilizer arm 16*a* through 16*d* extends into each of the quadrants defined by the stabilizer axes HS and LS, and as the stabilizer 10 is secured adjacent to the vertical axis VB of the bow B, which passes through the intersection of the two horizontal bow axes HB and LB, it will be seen that the four stabilizer arms 16*a* through 16*d*** also extend into the bow quadrants defined by the bow axes HB and LB.

The present archery bow stabilizer 10 is symmetrical about both its longitudinal axis HS and its lateral axis LS, with each of the right side arms **16*a* and 16*b*, and left side arms 16*c* and 16*d*, being angularly offset equally to each side of the longitudinal stabilizer axis HS (and thus also to each side of the lateral stabilizer axis LS). It will further be seen that the longitudinal axes of the two right side arms 16*a* and 16*b* intersect at a common point P1, to the right of the center of the attachment block 12, while the longitudinal axes of the left side arms 16*c* and 16*d* intersect at a common point P2 to the left of the center of the attachment block 12. These two common intersection points P1 and P2 serve to narrow the focus of the forces imposed upon the bow B (and thus the stabilizer 10 which is secured to the bow B), to consolidate those forces within the block 12** and immediately adjacent the center of the bow B.

Returning to FIG. 1, it will be seen that each of the stabilizer arms **16*a* through 16*d* is angled downwardly relative to the horizontal longitudinal axis HS of the stabilizer attachment block 12. Each of the arms 16*a* through 16*d* has a distal tip or end, respectively 18*a* through 18*d*, which ends provide for the removable attachment of weights thereto. The weights tend to distribute the mass of the stabilizer 10 outward, away from the center of the attachment block 12, which provides a greater moment for a given mass since the moment is equal to the mass multiplied by the length of the arm. The downward disposition of the arms 16*a* through 16*d*, and thus the weights on the tips 18*a* through 18*d*, results in the center of mass CS of the stabilizer 10 being lower than the attachment block 12, and thus the average center of mass of the combined bow B and stabilizer 10** is also lowered.

This lowering of the center of mass CS of the stabilizer 10, and thus of the bow and stabilizer assembly, provides significant benefits. Typically, the center of mass of a bow B is located very near, or along the same axis as, the arrow rest, as indicated by the intersection CB in FIG. 1. However, the hand grip area is centered somewhat below the arrow rest, as indicated by the hand grip center CH in FIG. 1. While the forces acting on an arrow launched from the bow B will cause the bow B to react generally about the center of the bow, which is located at or very near the arrow rest for stability, the archer's hand provides a resistive or reactive force which is positioned somewhat below the center of the bow B, as shown in FIG. 1. Thus, a couple is created by the opposing reactive forces of the bow B when the arrow is launched, and the hand of the archer positioned at the hand grip some distance below the arrow rest.

The present bow stabilizer 10 substantially overcomes such couple forces which tend to cause the bow B to tip about the lateral axis, as shown by the broken line alternative bow position in FIG. 1. By angling the arms 16*a* through 16*d* downward, and thus positioning the weight at the distal ends or tips 18*a* through 18*d* of the arms substantially lower than the attachment block 12, the stabilizer center of mass CS is lowered to a point substantially below both the bow center of mass CB and the center of the handgrip CH. The resulting average center of mass of the bow B and stabilizer 10 combination, will be seen to be displaced to a point substantially at the center of the hand grip CH. Thus, forces acting through the combined center of mass CH of the bow B and stabilizer S, are resisted directly by the hand of the archer located directly at the hand grip area of the bow B.

Preferably, each of the arms 16*a* through 16*d* has an equal downward angle (defined as the angle downward from the plane established by the two attachment block horizontal axes HS and LS), in order to provide common intersecting points P1 and P2 respectively for the two right side arms 16*a* and 16*b*, and the two left side arms 16*c* and 16*d*, and to eliminate the possible variable of different vertical positioning for any weights added to the tips 18*a* through 18*d* of the arms 16*a* through 16*d*. With each of the arms 16*a* through 16*d* preferably being equal in length, the result is a symmetrical stabilizer which is easier to "tune" as desired, as described below.

FIG. 3 provides a perspective view of the present stabilizer 10, and the means for adjusting the mass at the end of each stabilizer arm 16*a* through 16*d*. The weights and attachment means of the arm 16*b* are shown in an exploded format at the tip or end 18*b* of the arm 16*b*, and are identical for each of the arms 16*a* through 16*d*. One or more washers 20, each having a central hole or passage 22 therethrough, is provided, with a threaded bolt or screw 24 being used to secure the washer or washers 20 to the end 18*b* of the arm 16*b*. Each of the arms 16*a* through 16*d* is preferably formed of a hollow aluminum tube, as shown by the broken line interior of the tube 16*b*, with the tips or ends 18*a* through 18*d* having internal threads therein, as indicated by the threads 26 shown in broken lines within the end 18*b* of the arm 16*b*. Thus, the washers 20 may be removably installed on the ends 18*a* through 18*d* of the arms 16*a* through 16*d*, to adjust the individual masses of the arms 16*a* through 16*d*, and thereby adjust the center of mass CS of the stabilizer 10 and the combined mass CH of the stabilizer 10 and bow B to position it at the hand grip or other location, as desired.

Typically, the reaction of the bow B will be for the bow B to react rearwardly due to the forward acceleration of the arrow from the bow B. The archer will typically react by imposing a forward force on the bow B, which with a right handed archer (gripping the bow B with his/her left hand) will often result in a leftward or counterclockwise torque of the bow B about the vertical axis, as shown by the alternative position of the bow B shown in broken lines in FIG. 2. The present stabilizer 10 provides significant resistance to such forces, with considerable moment provided by the four elongate arms 16*a* through 16*d*. The torsion resisting moment provided, will be seen to be equal to that developed by a single arm having four times the length of any of the present arms 16*a* through 16*b*, or that developed by a single arm of the same length, but having four times the mass of any one of the present arms. (Preferably, the washers 20 are formed of a heavy metal, such as lead, for optimum performance; however, steel washers are readily available and may be used also.)

A further advantage is provided by the present stabilizer 10, in that the center of mass of the stabilizer may be adjusted relative to the two horizontal axes HS and LS, by adjusting the weights at the ends of each of the arms as desired. Thus, the center of mass of the stabilizer 10 may be adjusted to lie in alignment with that of the bow B, by adding weight to the rearward arms 16*b* and 16*c*, for a forwardly mounted stabilizer 10 as shown in FIG. 2. Other arrangements (e.g., left/right, etc.) are of course possible, depending upon the individual needs of the archer.

FIG. 1 shows another typical reactive force resulting from the release of an arrow, with the bow B being tipped forward (rotating about the lateral axis LB of the bow B). Again, the bow B itself reacts to the forward launch of an arrow with a rearward force, acting through the center of mass CB of the bow B (and any stabilizer or other mass attached thereto). Typically, the resulting center of mass is positioned above the hand grip, as shown in FIG. 1. This creates a couple tending to rotate the bow B rearwardly about the lateral axis (in the direction opposite that shown in FIG. 1).

However, the archer will typically react to such forces, by attempting to maintain the relative position and attitude of the bow B with his/her hand at the hand grip. Often, this results in an overcompensation which draws the bow B to the rear, thus causing the upper limb of the bow B to tip relatively forward, as shown by the broken lines in FIG. 1. The present stabilizer 10 resists this, by lowering the combined center of mass of the bow B and stabilizer 10 to a point essentially at the hand grip. Thus, any forward or rearward motion imparted to the bow B by the archer, will act straight through the combined center of mass CH of the bow B and stabilizer 10 combination, resulting in zero torsional forces applied to the bow B and substantially eliminating any tendency for the bow B to tip upward due to the reaction of the archer.

In summary, the present stabilizer 10 will be seen to provide additional stability for a bow B (either compound or conventional long bow) about all three mutually orthogonal axes (longitudinal, lateral, and vertical) of the bow, by means of the four angularly offset arms 16*a* through 16*d* provided. The ability of the archer to "fine tune" the different masses disposed at the ends 18*a* through 18*b* of the four arms 16*a* through 16*b*, provides extremely fine adjustment to compensate for any tendency of an archer to twist the bow B about any of the three axes of the bow B. By providing completely independent adjustment of the weight at each of the four arm tips or ends 18*a* through 18*d*, an archer may shift the center of mass of the bow-stabilizer combination to any practicable degree desired, from the left side to the right side of the bow B, or centered thereon, and/or from the forward to the rearward side of the handle area, or to any intermediate position desired, or any combination thereof.

It will further be seen that the addition of weights to the ends 18*a* through 18*d* of the arms 16*a* through 16*d*, will result in an average lowering of the center of mass of the bow B, thereby providing further stability. The versatility of the present stabilizer 10 allows it to achieve bow stabilizing functions which have been heretofore unattainable in a single stabilizing device.

It is to be understood that the present invention is not limited to the sole embodiment described above, but encompasses any and all embodiments within the scope of the following claims.

I claim:

1. An archery bow stabilizer removably attachable to a stabilizer attachment fitting on the front of an archery bow, said archery bow stabilizer comprising:

an attachment block having orthogonal longitudinal and lateral axes, and including means providing for the removable attachment of said attachment block to an archery bow, and;

two left and two right stabilizer arms extending outwardly from said attachment block, with each of said arms being angularly offset from said longitudinal and lateral axes of said attachment block and extending into a respective quadrant defined by said longitudinal and lateral axes of said attachment block, whereby;

said archery bow stabilizer is attached to the front stabilizer attachment fitting of the archery bow by said removable attachment means of said attachment block, with said longitudinal and lateral axes of said attachment block being respectively parallel to the longitudinal and lateral axes of the archery bow and with each of said stabilizer arms extending into said respective quadrant defined by said longitudinal and lateral axes of said attachment block, and undesired movement of the archery bow during arrow release is greatly reduced about the longitudinal and lateral axes of the bow.

2. The archery bow stabilizer of claim 1 wherein:

each of said arms defines an elongate axis, with said attachment block securing each of said arms therein to provide a left and a right intersection point respectively for each said elongate axis of said left arms and said right arms.

3. The archery bow stabilizer of claim 1 wherein:

said longitudinal and lateral axes of said stabilizer attachment block define a plane, and each of said stabilizer arms is disposed angularly downward from said attachment block to extend below said plane of said block, thereby defining an archery bow stabilizer center of mass disposed below said attachment block.

4. The archery bow stabilizer of claim 3 wherein:

each of said stabilizer arms has an equal downward angle from said plane of said attachment block.

5. The archery bow stabilizer of claim 1 wherein:

said angular offset of each of said stabilizer arms is equal relative to at least said longitudinal axis of said attachment block.

6. The archery bow stabilizer of claim 1 wherein:

each of said stabilizer arms includes a distal tip, with each said distal tip including means providing for the removable attachment of stabilizer weights thereto to provide for the adjustment of said archery bow stabilizer as desired.

7. The archery bow stabilizer of claim 6 wherein:

each of said stabilizer arms is a tube having an internally threaded distal tip, and said means providing for the removable attachment of weights thereto comprise washers with central holes therethrough and a threaded screw removably insertable through said washers and threadedly securing to said internally threaded distal tip of each of said arms.

8. The archery bow stabilizer of claim 7 wherein:

said stabilizer weights are heavy metal washers.

9. The archery bow stabilizer of claim 1 wherein:

at least said attachment block and said stabilizer arms are formed of aluminum.

10. In combination with an archery bow having orthogonal longitudinal, lateral, and vertical axes, and a stabilizer attachment fitting on at least the front portion thereof, an archery bow stabilizer comprising:

an attachment block having orthogonal longitudinal and lateral axes and including means providing for the removable attachment of said attachment block to said archery bow, with said longitudinal and lateral axes of said archery bow and of said attachment block being respectively parallel when said attachment block is secured to said archery bow, and;

two left and two right stabilizer arms extending outwardly from said attachment block, with each of said arms being angularly offset from said longitudinal and lateral axes of said attachment block and extending into a respective quadrant defined by said longitudinal and lateral axes of said attachment block, whereby;

said archery bow stabilizer is attached to said archery bow front stabilizer attachment fitting by said attachment block removable attachment means, with said attachment block longitudinal and lateral axes being respectively parallel to said archery bow longitudinal and lateral axes and with each of said stabilizer arms extending into said respective quadrant defined by said attachment block and archery bow longitudinal and lateral axes, and undesired movement of said archery bow during arrow release is greatly reduced about said archery bow longitudinal and lateral axes.

11. The combination archery bow and archery bow stabilizer of claim 10 wherein:

each of said arms defines an elongate axis, with said attachment block securing each of said arms therein to provide a left and a right intersection point respectively for each said elongate axis of said left arms and said right arms.

12. The combination archery bow and archery bow stabilizer of claim 10 wherein:

said archery bow includes an arrow rest and a center of mass substantially laterally coplanar therewith, and a hand grip disposed below said arrow rest and said center of mass, and;

said longitudinal and lateral axes of said stabilizer attachment block define a plane, and each of said stabilizer arms is disposed angularly downward from said attachment block to extend below said plane of said block to define an archery bow stabilizer center of mass disposed below said attachment block and further providing a combined archery bow and archery bow stabilizer center of mass disposed below said arrow rest and essentially longitudinally coplanar with said hand grip of said archery bow, whereby;

forces acting on said archery bow and said archery bow stabilizer about said combined archery bow and archery bow stabilizer center of mass during arrow release, occur substantially through said hand grip of said archery bow.

13. The combination archery bow and archery bow stabilizer of claim 12 wherein:

each of said stabilizer arms has an equal downward angle from said plane of said attachment block.

14. The combination archery bow and archery bow stabilizer of claim 10 wherein:

said angular offset of each of said stabilizer arms is equal relative to at least said longitudinal axis of said attachment block.

15. The combination archery bow and archery bow stabilizer of claim 10 wherein:

each of said stabilizer arms includes a distal tip, with each said distal tip including means providing for the removable attachment of stabilizer weights thereto to provide for the adjustment of said archery bow and said archery bow stabilizer.

16. The combination archery bow and archery bow stabilizer of claim 15 wherein:

each of said stabilizer arms is a tube having an internally threaded distal tip, and said means providing for the removable attachment of weights thereto comprise washers with central holes therethrough and a threaded screw removably insertable through said washers and threadedly securing to said internally threaded distal tip of each of said arms.

17. The combination archery bow and archery bow stabilizer of claim 16 wherein:

said stabilizer weights are heavy metal washers.

18. The combination archery bow and archery bow stabilizer of claim 10 wherein:

said stabilizer arms are aluminum tubes.

19. The combination archery bow and archery bow stabilizer of claim 10 wherein:

at least said attachment block and said stabilizer arms are formed of aluminum.

20. The combination archery bow and archery bow stabilizer of claim 10 wherein:

said archery bow is a compound bow.

* * * * *